US005983825A

United States Patent [19]

Nowak et al.

[11] Patent Number: 5,983,825

[45] Date of Patent: Nov. 16, 1999

[54] FLAG PROTECTIVE DEVICE

[75] Inventors: Florian I. Nowak, Newington; Glen L. Nowak, New Britain; Gary F. Nowak, Newington; Jay Giblin, Cheshire, all of Conn.

[73] Assignee: Nowak Products, inc., Newington, Conn.

[21] Appl. No.: 09/027,081

[22] Filed: Feb. 20, 1998

[51] Int. Cl.[6] ..... G09F 17/00

[52] U.S. Cl. ..... 116/173; 116/174

[58] Field of Search ..... 116/173, 174, 116/28 R, 63 P, 63 R; 40/317, 333, 334, 335, 514, 517, 218; 114/102, 104, 105

[56] References Cited

U.S. PATENT DOCUMENTS

| | | | |
|---|---|---|---|
| 470,873 | 3/1892 | Chapman et al. | 116/173 |
| 1,645,645 | 10/1927 | Davis | 116/173 |
| 2,324,056 | 8/1943 | Nelson . | |
| 2,452,842 | 11/1948 | Davis | 116/173 |
| 3,047,258 | 7/1962 | Hutchins . | |
| 3,418,967 | 12/1968 | Donkersloot . | |
| 3,737,749 | 6/1973 | Schmit . | |
| 3,861,343 | 1/1975 | Fretwell, Jr. . | |
| 3,923,001 | 12/1975 | Murdock . | |
| 4,079,555 | 3/1978 | Barnes . | |
| 4,102,289 | 7/1978 | Ebbeson et al. . | |
| 4,262,617 | 4/1981 | Svensson . | |
| 4,972,794 | 11/1990 | Smyly, Sr. . | |

FOREIGN PATENT DOCUMENTS

| | | | |
|---|---|---|---|
| 3737-655 | 5/1989 | Germany | 116/173 |

*Primary Examiner*—Andrew Hirshfeld
*Attorney, Agent, or Firm*—Ira S. Dorman

[57] ABSTRACT

The system includes a protective sleeve that is lowered over a flag under the weight of a carrier ring. An arrangement of cables and control means effects raising and lowering of the protective sleeve, and positions the lowered carrier in a tilted orientation to effectively close the lower end of the sleeve and thereby to afford enhanced protection for the contained flag.

12 Claims, 5 Drawing Sheets

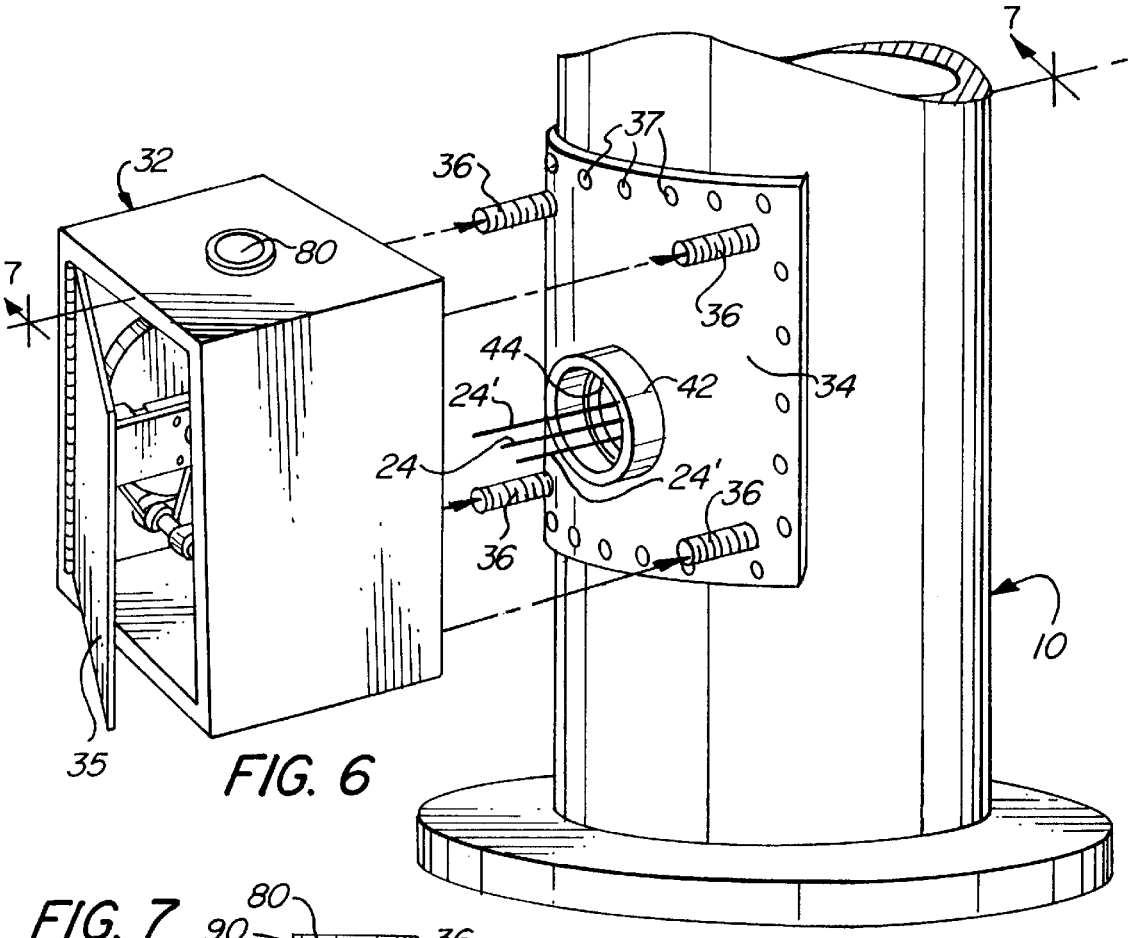
FIG. 6
FIG. 7
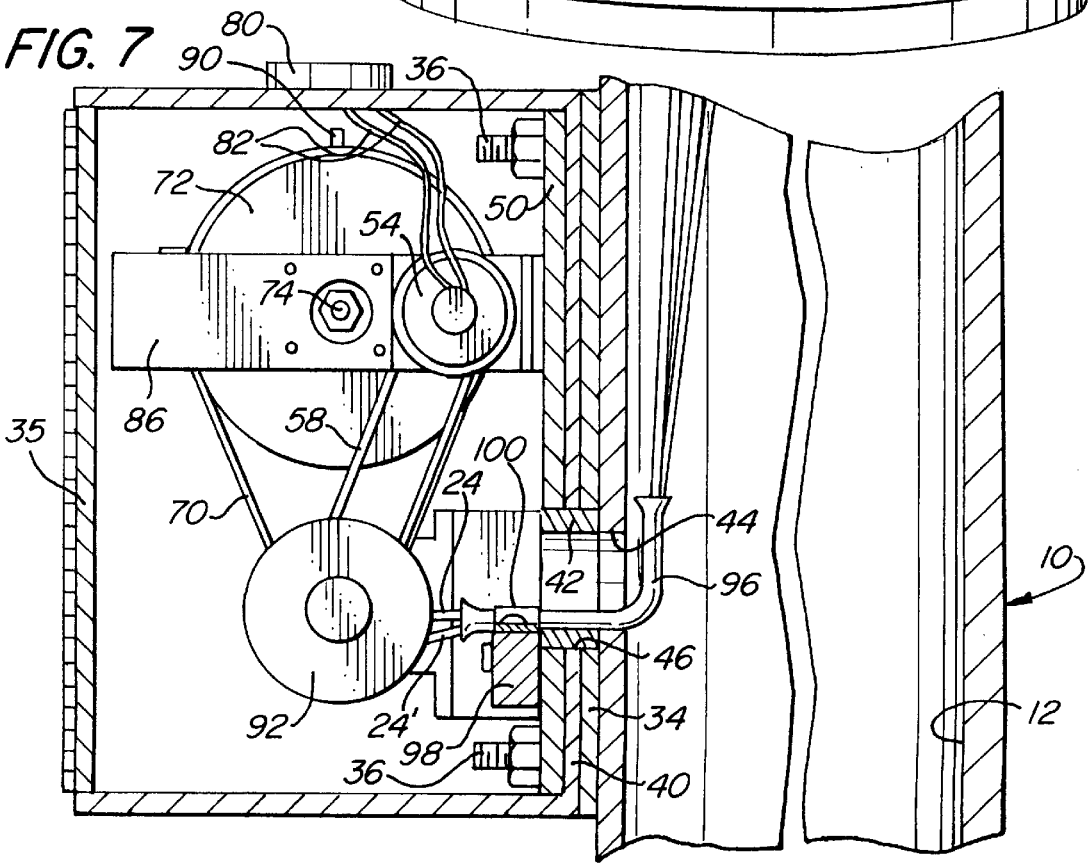

FIG. 8A
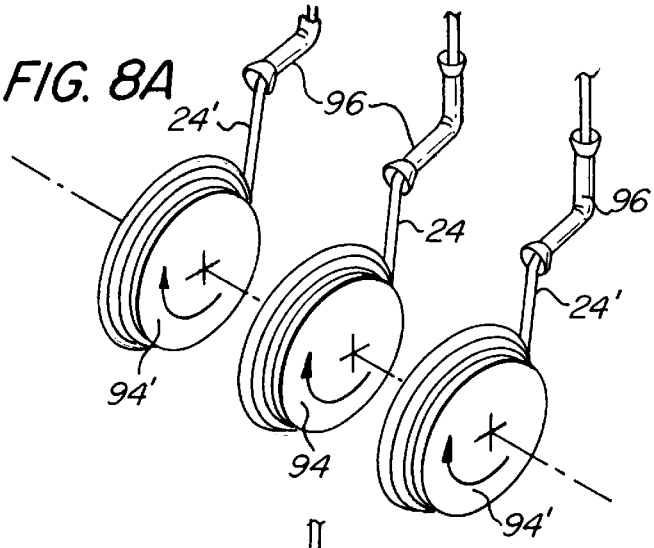
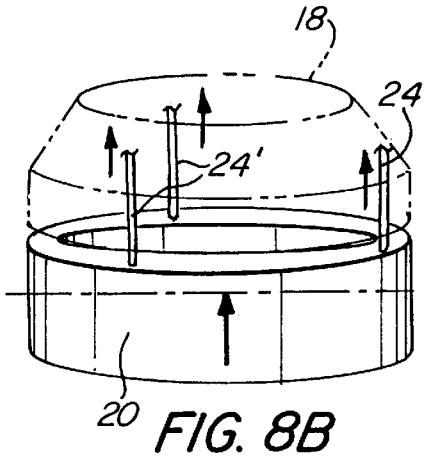
FIG. 8B
FIG. 9A
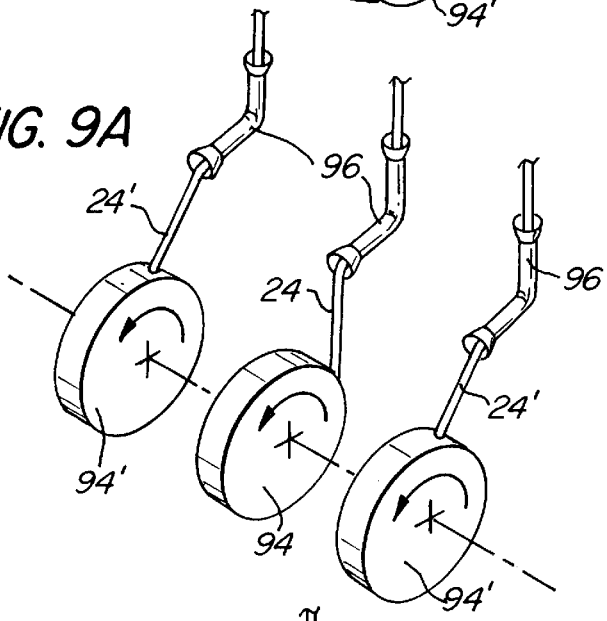
FIG. 9B
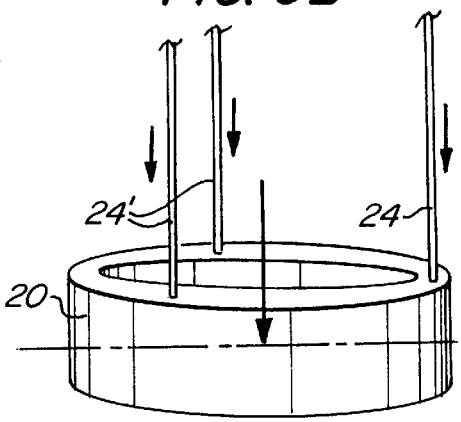
FIG. 10A
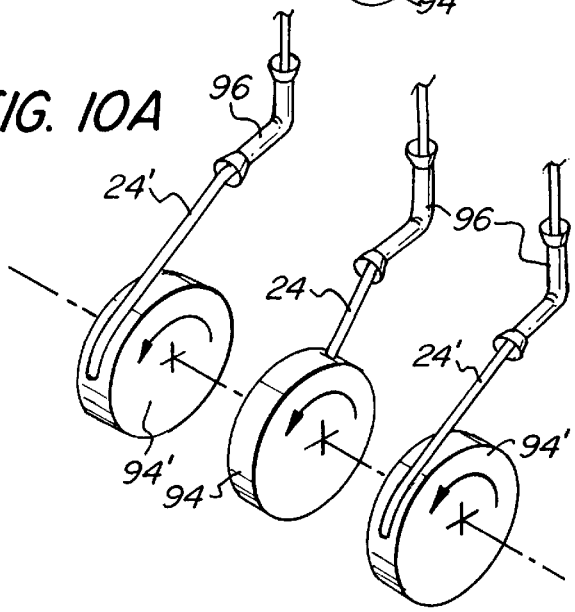
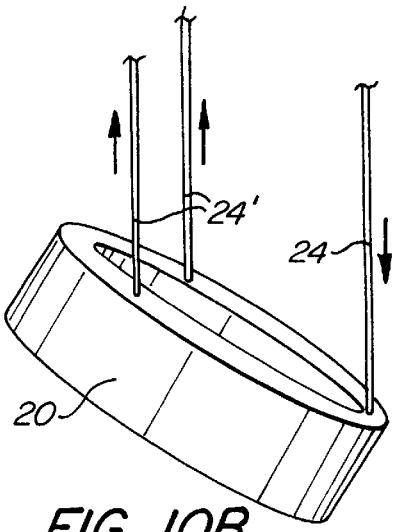
FIG. 10B

FLAG PROTECTIVE DEVICE

BACKGROUND OF THE INVENTION

Systems for automatically raising, lowering, and storing flags are well known in the art. Provision is commonly made for automatically operating such systems to lower or otherwise protect the flag in response to darkness, precipitation, and/or excessive wind velocity, and to thereafter display the flag when the ambient condition(s) are favorable. The following United States patents are representative of the prior art:

Nelson U.S. Pat. No. 2,327,056 provides an overhead tube used for storage of a flag.

Hutchins U.S. Pat. No. 3,047,258 provides a device for collapsing a parachute, which includes a funnel-like component having a ring of lead surrounding its leading edge.

Donkersloot U.S. Pat. No. 3,418,967 describes an automatic control system for lowering a flag to a stored position, which system includes climatic-response devices that operate according to light, wind, and precipitation conditions; manual control is also indicated.

U.S. Pat. No. 3,737,749, to Schmit, provides a selector switch that allows either manual rasing of a flag or automatic control, the latter utilizing, for example, a photocell to respond to prevailing light conditions.

Murdock U.S. Pat. No. 3,923,001 contains similar disclosure, but also teaches the utilization of a moisture sensor for moving a flag to a stored position within a tube.

In accordance with Barnes, U.S. Pat. No. 4,079,555, a control unit is provided which has both light and moisture sensors, as well as manually operated switches, to control furling and raising of a flag.

In Ebbeson et al. U.S. Pat. No. 4,102,289, an elongate, collapsible sleeve is disposed for being drawn downwardly to contain and furl a boat sail; a rigid, funnel-shaped member is attached to the lower end of the sleeve. Fretwell Jr. U.S. Pat. No. 3,861,343 and Svensson U.S. Pat. No. 4,262,617 are similar.

Smyly, Sr., U.S. Pat. No. 4,972,794, discloses a system in which a housing, coaxially mounted on a flag staff, is elevated to contain the supported flag; the housing is in the form of a hollow cylinder, open at the top and closed at the bottom.

SUMMARY OF THE INVENTION

Despite the activity in the art indicated by the foregoing, a need remains for a system by which a flag supported on a staff can alternatively be protectively enclosed or displayed, which system affords an enhanced level of protection to the contained flag. Accordingly, it is the broad object of the present invention to provide a system having the foregoing features and advantages.

Other objects of the invention are to provide such a system which is in addition relatively incomplex and economical to manufacture and install, and is highly effective for its intended purpose.

It is now been found that the foregoing and related objects of the invention are attained by the provision of a system comprising a substantially vertical staff having upper and lower ends and a longitudinal axis; means for suspending a flag adjacent the upper end of the staff, to hang along an axial portion thereof; a protective sleeve unit mounted adjacent the upper end of the staff; and operating means, usually constituting cable-operating means and a coacting plurality of cables. The sleeve unit includes an elongate sleeve made from a protective material and disposed generally coaxially of the staff; it has a mouth at its lower end, lying generally on a plane, and is compressible and extensible along its longitudinal axis. The protective unit also includes carrier structure of substantially rigid form and relatively large mass circumscribing the mouth of the sleeve. The sleeve and the carrier structure are so constructed, mounted, and disposed as to enable movement of the carrier structure between an elevated position, adjacent the upper end of the axial staff portion, and a lowered position adjacent the lower end of the axial staff portion; in the elevated position the sleeve is compressed to display a flag supported by the means for supporting, and in the lowered position the sleeve is extended to substantially surround the axial staff portion and protectively enclose the flag. The mass of the carrier structure is such as to promote extension of the sleeve and movement of the carrier structure toward its lowered position, and the opening therethrough is dimensioned and configured for free passage of the axial staff portion with substantial clearance therebetween in the lowered position of the carrier structure. In most instances the system will employ cables that are operatively attached, adjacent their opposite ends, to cable-operating means and to the sleeve unit. The cables and the cable-operating means (or the more broadly defined operating means itself), will be disposed and arranged to support the carrier structure and to effect its elevation, and will be so constructed that the plane on which the mouth of the sleeve lies is substantially horizontal, in the elevated position of the carrier structure, and is substantially titled from horizontal in the lowered position. The tilted orientation causes the carrier structure to close upon the staff and to thereby afford enhanced protection for the flag contained within the sleeve.

In preferred embodiments of the system, the cable-operating means will comprise at least one rotatable spool member about which the cables can wind simultaneously, by rotation of the spool member in a first, take-up direction so as to effect elevation of the carrier structure, and from which the cables can unwind, by rotation of the spool member in the opposite, pay-out direction so as to effect lowering of the carrier structure. The cables will be of substantially equal effective length with the carrier structure in its elevated position, and of different effective lengths with the carrier structure in its lowered position. More particularly, at least one, effectively longer cable will have an end portion remaining wound on the spool member when at least one other, effectively shorter cable will have reached its full pay-out length. Continued rotation of the spool member in the pay-out direction, to permit the first cable to reach its full pay-out length, will therefore cause an end portion of the other cable to wrap about the spool member, in the direction opposite to its direction of unwinding, with the resultant effective shortening of the second cable producing the desired titled orientation of the carrier structure in its lowered position.

Usually, the system will additionally include means for driving rotation of the spool member (or for driving the operating means), together with means for controlling the drive means. Such control means will include means for sensing at least one ambient condition and for generating a signal, in response to at least one established criterion for that condition, for automatically effecting actuation of the drive means.

BRIEF DESCRIPTION OF THE DRAWINGS

FIG. 6 is a fragmentary perspective view showing, in exploded relationship, the control and operating unit and the flag staff;

FIG. 7 is a sectional view taken substantially along line 7—7 of FIG. 6;

FIG. 8A is a diagrammetric perspective representation of the spools and cables that are employed, in the system illustrated, for operating the protective sleeve unit, conditioned for supporting the sleeve unit in an elevated position; and FIG. 8B is a perspective view of the carrier ring of the protective unit depicted in the corresponding elevated position;

FIGS. 9A and 9B correspond to FIGS. 8A and 8B, respectively, conditioned and depicted with the sleeve unit fully lowered and the carrier ring in a horizontal orientation; and FIG. 10A and 10B correspond to the forgoing Figures and show the final stage of operation with the carrier ring in an orientation tilted from horizontal.

DETAILED DESCRIPTION OF THE PREFERRED AND ILLUSTRATED EMBODIMENT

Figure 1:
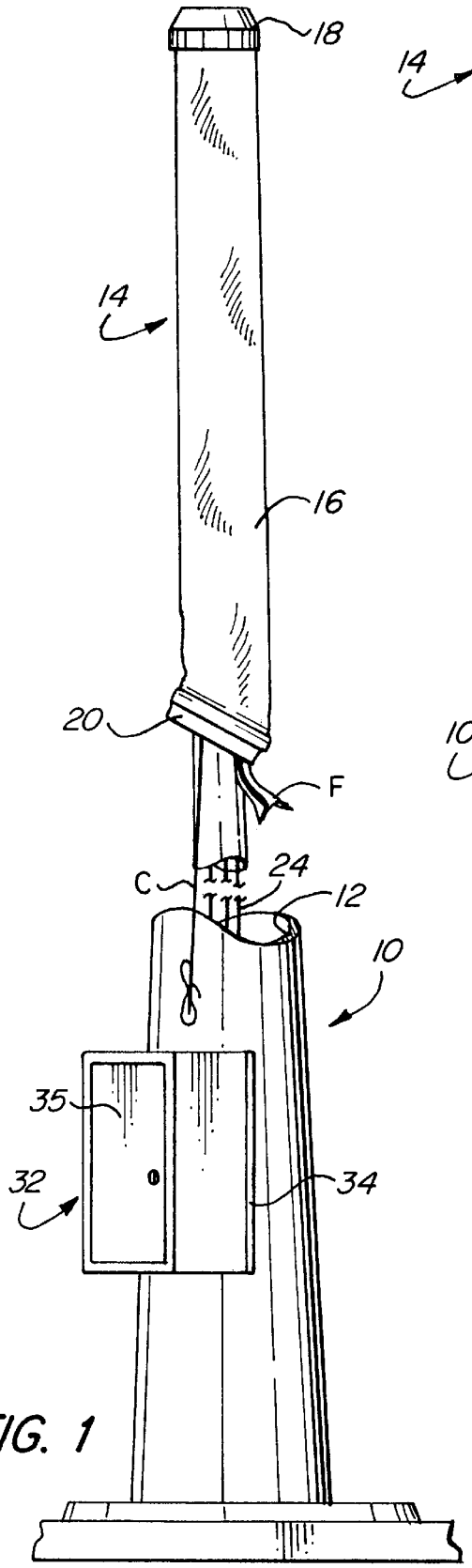
FIG. 1 is a fragmentary elevational view of a flag displaying and protecting system embodying the present invention, showing a flag enclosed within a protective sleeve.

Turning now in detail to the appended drawings, therein illustrated is a system embodying the present invention and including a tapered flag staff, generally designated by the numeral 10, and a protective sleeve unit, generally designated by the numeral 14 mounted thereon. A flag F is supported on an upper portion of the staff 10 for raising and lowering in conventional fashion, using an arrangement of cords C and pulleys (not shown).

Sleeve unit 14 consists of a flexible, compressible sleeve 16, and a carrier ring 20 circumscribing the mouth 22 at its lower end. The sleeve 16 is attached at its upper end to a top cap 18, which is in turn secured by screws 19 over the end of the staff 10. Three cables 24, 24' extend through the axial passage 12 of the staff 10, and are guided radially outwardly therefrom and under the cap 18 through angled tube guides 26; one end of each cable 24, 24' is attached to the carrier ring 20. It is to be noted that the central opening 28 through the carrier ring 20 is of sufficiently large diameter to enable free passage along and tilting of the ring on the corresponding portion of the staff 10, the effect being promoted by the presence of the champferred upper and lower circumferential edges 30 surrounding the opening 28.

The control unit consists of a housing, generally designated by the numeral 32, attached to a flexible mounting panel 34, the panel 34 in turn being secured by rivets 37 near the base of the staff 10. Four threaded studs 36 project from the panel 34 and extend through holes 38 in the rear wall 40 of the housing 32, and are engaged by nuts to mount the control unit on the flag staff. A collar 42 surrounds the relatively large hole 44 in the panel 34, and projects therefrom through the corresponding hole 46 in the wall 40; the collar 42 also extends through an aligned hole 48 formed in a mounting plate 50 disposed within the housing 32. A lockable, hingedly mounted door 35 provides secure access to the interior of the housing 32.

A first L-shaped bracket 52 is attached to the mounting plate 50 and serves to support a bidirectional electric motor 54 on its forwardly projecting arm 56. A pinion (not visible) is attached to the drive shaft of the motor 54 and is connected by a timing belt 58 to a cooperating pinion 60, which is affixed by a key (not shown) on an axially slotted shaft 62; one end of the shaft 62 is journalled in a pillow block 64, and an interposed spacer 66 mounts the pillow block 64 to the panel 50. The shaft 62 carries a second pinion 68, which is affixed for rotation therewith and is connected through a second timing belt 70 to a control wheel 72. The wheel 72 is rotatably mounted by screw 74 on the arm 76 of a second L-shaped bracket 78, which is also mounted on the plate 50.

A photoelectric cell 80 is mounted on the top wall 33 of the housing 32 and is connected by wires 82 to the motor 54; the cell 80 is of course positioned for exposure to solar radiation. A limit switch 84 is attached to the outer end of the bar 86 (which is in turn attached to the arm 76) and has a switch actuating finger 88 which projects laterally adjacent the edge of the control wheel 72. Contact dogs 90 are selectively positionable on the wheel 72 for engaging the contact finger 88 of the limit switch 84 for control of operation of the motor 54. As will be appreciated, a suitable power supply and wiring (neither of which is shown) will be provided to supply current to the motor 54 and to operatively connect the motor to the limit switch 84.

Figure 5:
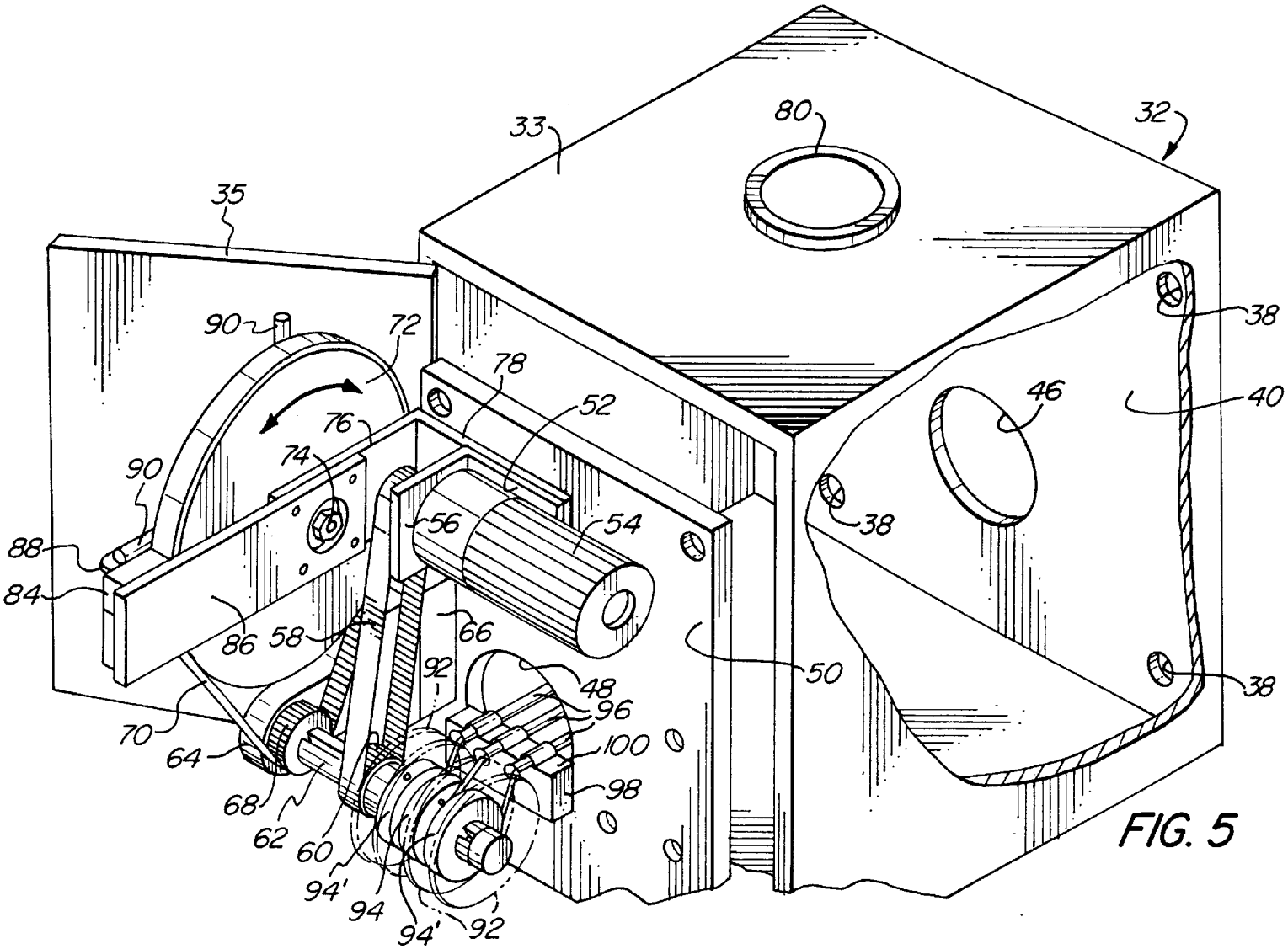
FIG. 5 is a fragmentary, partially exploded view of the control and operating unit of the system, drawn to a greatly enlarged scale.

Also mounted upon the shaft 62 are four separator discs 92 (shown in phantom line in FIG. 5) and a bank of three spools 94, 94', discs 92 being interposed between adjacent spools 94, 94' as well as being disposed at the opposite ends of the spool bank. Like the pinions 60 and 68, the spools 94, 94' are keyed to the slotted shaft 62 for conjoint rotation therewith. As can be seen in FIGS. 6 and 7, the three cables 24, 24' pass outwardly of the axial passage 12 of the staff 10, through the wall opening 44, and thereafter through the collar 42 on the mounting panel 34. Three right-angle tube guides 96, held in a retainer block 98 by a clamping plate 100, guide the cables 24, 24' onto a dedicated one of the spools 94, 94'.

Figure 2:
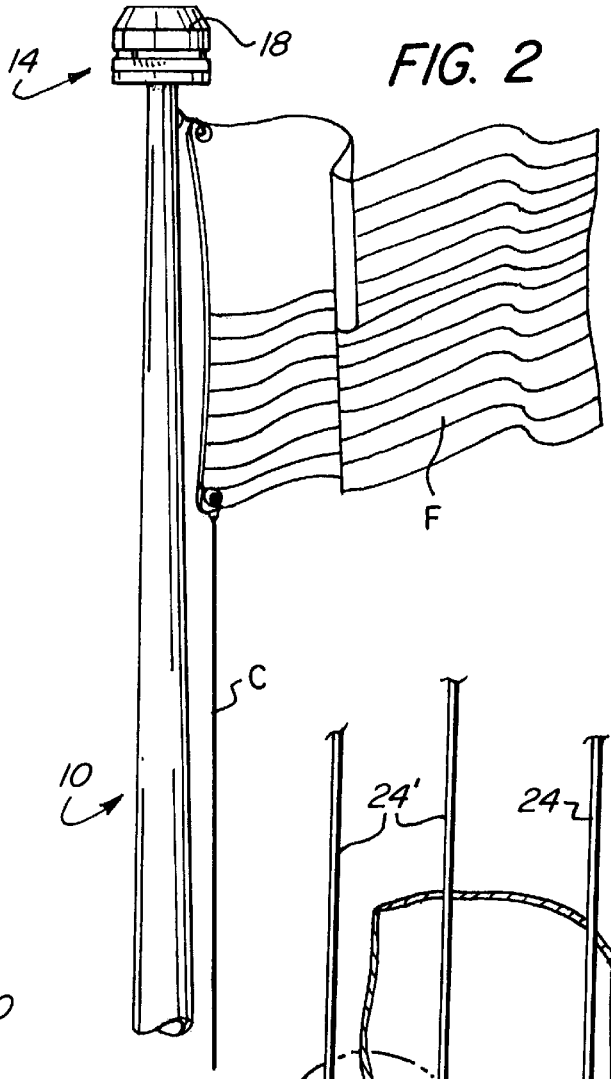
FIG. 2 is a fragmentary elevational view showing the upper portion of the flag staff with the sleeve and carrier structure of the protective unit elevated and withdrawn from the flag.
Figure 3:
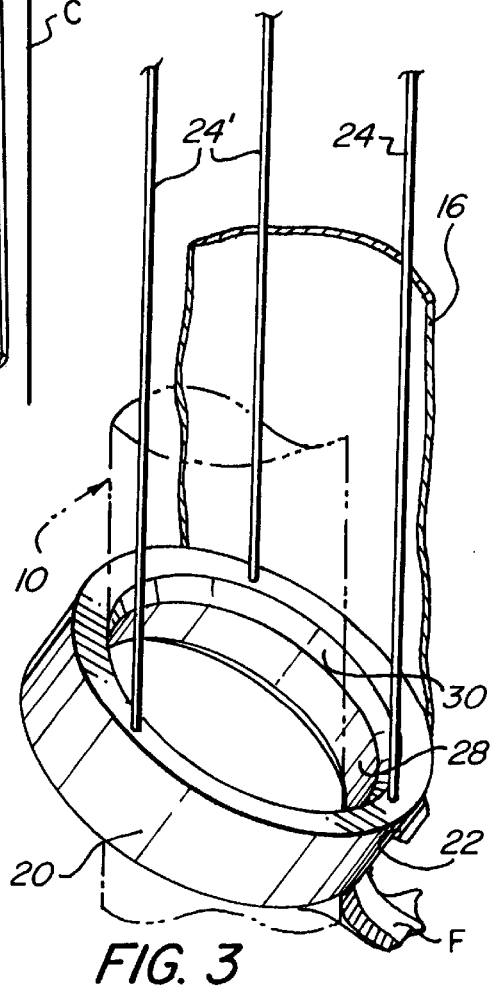
FIG. 3 is a fragmentary perspective view, drawn to an enlarged scale, showing the protective sleeve unit disposed in an enclosing relationship.
Figure 4:
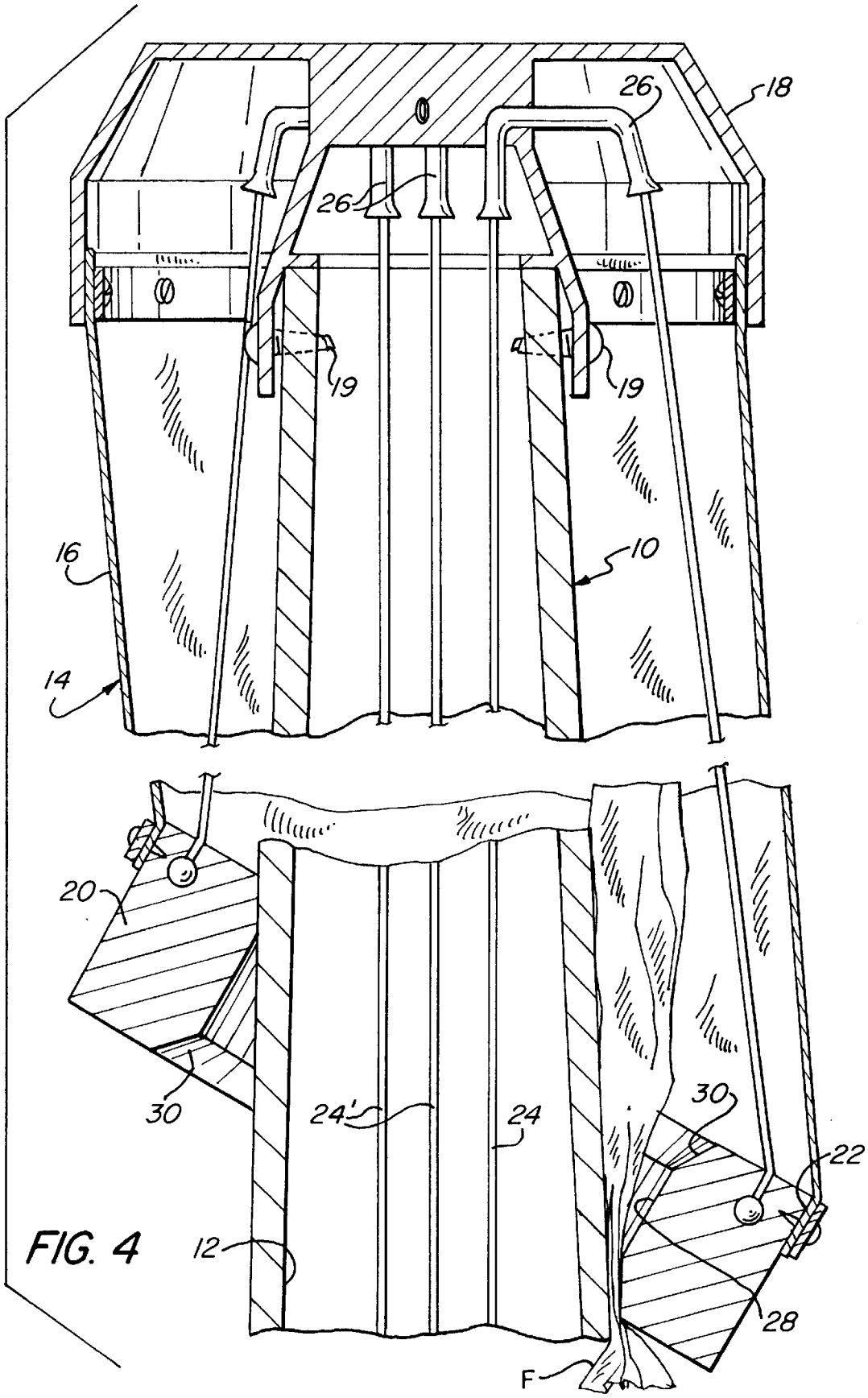
FIG. 4 is a fragmentary cross-sectional view of the top of the flag staff drawn to a further enlarged scale and showing the protective sleeve unit in an enclosing relationship.

It will be appreciated that, with the carrier ring 20 positioned as shown in FIGS. 1, 3, 4, and 10B, rotation of the shaft 62 by the motor 54 (through the pinion and belt connections described), in the counterclockwise direction indicated by the arrows in FIG. 10A, will cause the cables 24, 24' to wind upon the respective spools 94, 94' to thereby elevate the carrier ring 20 and, in turn, to effect upward compression of the sleeve 16. With the ring 20 in its fully elevated position, depicted in FIGS. 2 and 8B, the supported flag F will of course be released from its protectively enclosed condition, for display.

A unique feature of the system of the invention resides in the dynamic action of the carrier ring 20. It serves not only to promote effective lowering of the protective sleeve 16 (by mere virtue of its mass) as the cables 24, 24' are unwound from their respective spools 94, 94', but it also operates to effectively close the mouth 22 of the sleeve 16. The cables 24, 24' and the spools 94, 94' are so arranged and related that the two cables 24' have an effective length that is somewhat shorter than that of the cable 24 in the fully lowered position of the carrier ring 20. The resultant tilting from a normally horizontal orientation causes the ring 20 to effectively close the mouth 22 of the sleeve 16 upon the shaft 10, below the contained flag F.

More particularly, and as is best seen in FIGS. 9A and 10A, the cable 24 on the central spool 94 is so attached as to be 90° out of phase with the two outer cables 24' (i.e., the angular relationship of the outer spools 94' on the shaft 62 is such as to lead the center spool 94 by 90°). Because of this relationship the outer cables 24' are fully unwound from the spool 94' (see FIG. 9A) while 90° of wrap of the attached end portion of the cable 24 remains on the spool 94. Continued rotation of the shaft 62 (in the counterclockwise direction), so as to achieve full extension of the center cable 24, will cause the outer cables 24' to rewrap (in the direction opposite to their pay-out direction) during the last 90° of rotation and thereby to produce the relationship depicted in FIG. 10A. The effective length of the cables 24' thereby becomes shorter than that of cable 24, thus elevating the side of the ring 20 to which the cables 24' are attached and producing the desired canted orientation.

Although overall operation of the system will be self evident, it is nevertheless briefly described as follows: Assuming the flag F to be in the displayed mode when the photoelectric cell 80 senses a darkening condition, an electrical signal is generated and impressed upon the bidirectional motor 54, initiating rotation of its shaft in a first direction. The motor drives the bank of spools 94, 94' in the direction to cause unwinding of the cables 24, 24' and thereby to effect lowering of the ring 20 and sleeve 16 over the flag F. The motor 54 continues to operate until one of the dogs 90 on the rotating wheel 72 contacts the finger 88 of the limit switch 84; that dog 90 is set to terminate power when the conditions depicted in FIG. 10B are attained.

Upon detecting sufficient daylight, a signal is generated by the cell 80 for initiating operation of the motor 54 in the reverse direction, causing the cables 24, 24' to be taken up upon the spools 94, 94' (rotating in the clockwise direction, as indicated in FIG. 8A) and, in turn, elevating the carrier ring 20 so as to withdraw the sleeve 16. Needless to say, the second dog 90 is so located on the wheel 72 as to cause the motor to operate until the flag F is exposed.

It should be noted that the components of the system will generally be so designed and arranged that a small portion of the flag (i.e., the bottom front corner) will protrude in the fully lowered position of the ring; if it were otherwise the flag would tend to become bunched within the sleeve as the sleeve is upwardly compressed, rather than being released as intended. Alternatively, means may be devised for automatically clamping the collapsed flag or for otherwise holding it in position while the sleeve is withdrawn.

The protective sleeve may be fabricated from any suitable material, the nature of which will be apparent to those skilled in the art in light of the description of its function and character hereinabove provided; tightly woven fabrics, such as canvas, nylon, and the like (preferably having waterproof properties), will typically be utilized. While the carrier structure will conveniently constitute a unitary ring of a relatively heavy metal, other materials and/or forms may be substituted. For example, the necessary weight and rigidity might be provided by a mass of lead shot packed tightly into a channel (conveniently formed from the material of the sleeve itself) surrounding the open mouth. Although the sleeve 16 and ring 20 (and particularly the opening therethrough) will normally be of circular cross section (especially to conform to a conventional circular flag pole), that will also not necessarily be the case.

It will be appreciated that the photoelectric cell described hereinabove is merely illustrative of the several kinds of ambient condition sensors that can be utilized (alone or in various combinations) in the present system. A suitably placed moisture sensor would of course serve to sense precipitation, and an anemometer would serve to sense excessive wind velocity, both to initiate lowering and raising of the sleeve as appropriate. Other mechanisms and arrangements for shortening the effective length one or more of the cables, relative to that of at least one other cable, may also be employed, and it will be evident that the cable operating means may be manual rather than power-driven. The sensor, controls, and cable-winding mechanism need not be located near the base of the flag staff as illustrated, and positioning them elsewhere may be more suitable and/or more advantageous (e.g., a wind sensor would normally be positioned at the top of the staff). Although an arrangement of cables, as described, constitutes the best mode presently contemplated for carrying out the invention, the system may employ operating means that is itself capable of raising, lowering, and orienting the carrier ring (or that operates through means other than cables) so as to achieve the objectives set forth. Finally, while a hollow flag staff will allow convenient containment of the operating cables (and perhaps wires for sensors and the like), the system may of course be designed for use with a solid pole.

Thus, it can be seen that the present invention provides a novel system by which a flag supported on a staff can alternatively be protectively enclosed or displayed, which system affords an enhanced level of protection for the flag. The invention also provides such a system which is, in addition, relatively incomplex and economical to manufacture and install, and is highly effective for its intended purpose.

Having thus described the invention, what is claimed is:

1. A system for alternatively displaying and protecting a flag, comprising:

a substantially vertical staff having upper and lower ends, and a longitudinal axis;

means for suspending a flag adjacent said upper end of said staff to hang along an axial portion thereof;

a protective sleeve unit mounted adjacent said upper end of said staff and comprising an elongate sleeve having a longitudinal axis disposed generally coaxially with said axis of said staff, and having a mouth lying generally on a plane at the lower end of said sleeve, said sleeve being fabricated from a protective material and being compressible and extensible along said longitudinal axis thereof, said sleeve unit further comprising carrier structure of substantially rigid form and relatively large mass circumscribing said mouth of said sleeve, said sleeve and said carrier structure being so constructed, mounted, and disposed as to enable movement of said carrier structure between an elevated position adjacent the upper end of said axial staff portion, in which elevated position said sleeve is compressed to effect display of a flag supported by said means for suspending, and a lowered position adjacent the lower end of said axial staff portion, in which lowered position said sleeve is extended to substantially surround said axial staff portion and protectively enclose a flag so supported, the mass of said carrier structure being such as to promote extension of said sleeve and movement of said carrier structure toward said lowered position thereof, and said carrier structure having an opening for free passage of said axial portion of said staff therethrough, with substantial clearance therebetween in said lowered position of said carrier structure;

cable-operating means; and a plurality of cables having opposite ends, each of said cables being operatively attached adjacent one of said opposite ends to said cable-operating means and being operatively attached adjacent the other of said opposite ends to said sleeve unit, said cables being disposed to support said carrier structure and to effect elevation thereof from said lowered position to said elevated position by operation of said cable-operating means, said cables and said cable-operating means being constructed and arranged so that said plane on which said mouth of said sleeve lies is substantially horizontal in said elevated position of said carrier structure, and so that said plane on which said mouth lies is substantially titled from horizontal in said lowered position of said carrier structure, the resultant tilted orientation of said mouth causing said carrier structure to close substantially upon said staff and thereby to afford enhanced protection for a flag contained within said sleeve.

2. The system of claim 1 wherein said carrier structure comprises a unitary annular part disposed at said mouth of said sleeve.

3. The system of claim 1 additionally including at least one direction-reversal cable-supporting element adjacent said upper end of said staff, said cables passing over said cable-supporting element and reversing their direction of movement thereupon.

4. The system of claim 3 wherein said staff has an axial passage with an entrance for said cables thereinto adjacent said lower end of said staff and with an exit for said cables therefrom adjacent said cable-supporting element, said cables extending from said cable-operating means through said entrance and along said staff passage to said cable-supporting element.

5. The system of claim 1 wherein said cable-operating means comprises at least one rotatable spool member about which said cables can wind simultaneously, by rotation of said spool member in a first, take-up direction, so as to effect elevation of said carrier structure, and from which said cables can unwind simultaneously, by rotation of said spool member in a second, pay-out direction, opposite to said first direction, so as to effect lowering of said carrier structure, said plurality of cables consisting of cables that are of substantially equal effective length, between said spool member and said carrier structure, with said carrier structure in said elevated position thereof, and that are of different effective lengths, between said spool member and said carrier structure, with said carrier structure in said lowered position thereof, at least one first, effectively longer one of said cables having a portion remaining wound on said spool member when at least one second, effectively shorter one of said cables has reached its full pay-out length, so that continued rotation of said spool member in said pay-out direction, to permit said first cable to reach its full pay-out length, will cause a portion of said second cable to wrap about said spool member, in the direction opposite to its direction of unwinding, with the resultant effective shortening of said second cable thereby producing said titled orientation of said carrier structure in said lowered position thereof.

6. The system of claim 5 wherein said plurality of cables comprises at least three cables.

7. The system of claim 5 additionally including drive means for driving rotation of said spool member, and control means for controlling said drive means.

8. The system of claim 7 wherein said control means includes sensing means for sensing at least one ambient condition and for generating a signal, in response to at least one established criterion for said condition, for effecting actuation of said drive means.

9. A system for alternatively displaying and protecting a flag, comprising:

a substantially vertical staff having upper and lower ends, and a longitudinal axis;

means for suspending a flag adjacent said upper end of said staff to hang along an axial portion thereof;

a protective sleeve unit mounted adjacent said upper end of said staff and comprising an elongate sleeve having a longitudinal axis disposed generally coaxially with said axis of said staff, and having a mouth lying generally on a plane at the lower end of said sleeve, said sleeve being fabricated from a protective material and being compressible and extensible along said longitudinal axis thereof, said sleeve unit further comprising carrier structure of substantially rigid form and relatively large mass circumscribing said mouth of said sleeve, said sleeve and said carrier structure being so constructed, mounted, and disposed as to enable movement of said carrier structure between an elevated position adjacent the upper end of said axial staff portion, in which elevated position said sleeve is compressed to effect display of a flag supported by said means for suspending, and a lowered position adjacent the lower end of said axial staff portion, in which lowered position said sleeve is extended to substantially surround said axial staff portion and protectively enclose a flag so supported, the mass of said carrier structure being such as to promote extension of said sleeve and movement of said carrier structure toward said lowered position thereof, and said carrier structure having an opening for free passage of said axial portion of said staff therethrough, with substantial clearance therebetween in said lowered position of said carrier structure; and operating means operatively attached to said sleeve unit for supporting said carrier structure and effecting elevation thereof from said lowered position, said operating means being constructed and arranged so that said plane on which said mouth of said sleeve lies is substantially horizontal in said elevated position of said carrier structure, and so that said plane on which said mouth lies is substantially titled from horizontal in said lowered position of said carrier structure, the resultant tilted orientation of said mouth causing said carrier structure to close substantially upon said staff and thereby to afford enhanced protection for a flag contained within said sleeve.

10. The system of claim 9 wherein said carrier structure comprises a unitary annular part disposed at said mouth of said sleeve.

11. The system of claim 9 additionally including drive means for operating said operating means, and control means for controlling said drive means.

12. The system of claim 11 wherein said control means includes sensing means for sensing at least one ambient condition and for generating a signal, in response to at least one established criterion for said condition, for effecting actuation of said drive means.

* * * * *